US008299709B2

(12) United States Patent
Bewlay et al.

(10) Patent No.: US 8,299,709 B2
(45) Date of Patent: Oct. 30, 2012

(54) LAMP HAVING AXIALLY AND RADIALLY GRADED STRUCTURE

(75) Inventors: Bernard Patrick Bewlay, Schenectady, NY (US); Dennis Joseph Dalpe, Schenectady, NY (US); Bruce Alan Knudsen, Amsterdam, NY (US); Mohamed Rahmane, Clifton Park, NY (US); Svetlana Selezneva, Niskayuna, NY (US); James Scott Vartuli, Rexford, NY (US); James Anthony Brewer, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 627 days.

(21) Appl. No.: 11/702,319

(22) Filed: Feb. 5, 2007

(65) Prior Publication Data

US 2008/0185963 A1 Aug. 7, 2008

(51) Int. Cl.
*H01J 17/18* (2006.01)

(52) U.S. Cl. ..... 313/623; 313/625

(58) Field of Classification Search ..... 313/623, 313/624, 625, 42, 43, 246–248, 282, 283; 445/22, 23, 26–29, 32, 33, 44
See application file for complete search history.

(56) References Cited

U.S. PATENT DOCUMENTS

| | | | | |
|---|---|---|---|---|
| 3,363,134 | A | | 1/1968 | Johnson |
| 3,385,463 | A | | 5/1968 | Lange |
| 3,659,138 | A | | 4/1972 | Johnson et al. |
| 3,662,455 | A | | 5/1972 | Anderson |
| 3,693,007 | A | | 9/1972 | Kerekes |
| 3,872,341 | A | | 3/1975 | Werner et al. |
| 3,882,344 | A | | 5/1975 | Knochel et al. |
| 3,882,346 | A | | 5/1975 | McVey |
| 4,103,200 | A | | 7/1978 | Bhalla |
| 4,155,758 | A | * | 5/1979 | Evans et al. ..... 75/232 |
| 4,291,250 | A | | 9/1981 | Bhalla |
| 4,354,964 | A | | 10/1982 | Hing et al. |
| 4,464,603 | A | | 8/1984 | McVey |
| 4,507,584 | A | | 3/1985 | Coaton et al. |
| 4,585,972 | A | | 4/1986 | Hing |
| 4,602,956 | A | * | 7/1986 | Partlow et al. ..... 75/235 |

(Continued)

FOREIGN PATENT DOCUMENTS

EP 0887838 A2 12/1998

(Continued)

OTHER PUBLICATIONS

U.S. Appl. No. 11/289,128, Bewlay et al.

(Continued)

*Primary Examiner* — Nimeshkumar Patel
*Assistant Examiner* — Steven Horikoshi
(74) *Attorney, Agent, or Firm* — Paul J. DiConza

(57) ABSTRACT

A lamp is provided with an axially and radially graded structure to reduce the possibility of thermal stresses, cracks, and other defects in the lamp. In one embodiment, a system includes a ceramic lamp having a ceramic arc envelope and an end structure coupled to the ceramic arc envelope, wherein the end structure is graded both axially and radially into a plurality of regions. In another embodiment, a system includes a lamp having a layered end structure with a plurality of layers disposed one over another and that extend in both axial and radial directions relative to an axis of the lamp, wherein the plurality of layers include different materials having different coefficients of thermal expansion, Poisson's ratios, or elastic moduli, or a combination thereof.

7 Claims, 5 Drawing Sheets

U.S. PATENT DOCUMENTS

| | | | | |
|---|---|---|---|---|
| 4,780,646 | A | 10/1988 | Lange | |
| 4,804,889 | A | 2/1989 | Reid et al. | |
| 5,321,335 | A | 6/1994 | Klug et al. | |
| 5,404,078 | A * | 4/1995 | Bunk et al. | 313/625 |
| 5,426,343 | A | 6/1995 | Rhodes et al. | |
| 5,552,670 | A | 9/1996 | Heider et al. | |
| 5,742,123 | A * | 4/1998 | Nagayama | 313/623 |
| 5,810,635 | A * | 9/1998 | Heider et al. | 445/26 |
| 5,861,714 | A | 1/1999 | Wei et al. | |
| 5,973,453 | A | 10/1999 | Van Vliet et al. | |
| 5,994,839 | A | 11/1999 | Yamamoto et al. | |
| 6,069,456 | A | 5/2000 | Fromm et al. | |
| 6,126,889 | A | 10/2000 | Scott et al. | |
| 6,139,386 | A * | 10/2000 | Suzuki et al. | 445/26 |
| 6,215,254 | B1 | 4/2001 | Honda et al. | |
| 6,216,889 | B1 | 4/2001 | Chang | |
| 6,265,827 | B1 | 7/2001 | Takahashi et al. | |
| 6,294,871 | B1 | 9/2001 | Scott et al. | |
| 6,300,716 | B1 | 10/2001 | Honda et al. | |
| 6,375,533 | B1 * | 4/2002 | Torikai et al. | 445/26 |
| 6,404,129 | B1 | 6/2002 | Hendricx et al. | |
| 6,528,945 | B2 | 3/2003 | Kelly et al. | |
| 6,583,563 | B1 | 6/2003 | Venkataramani et al. | |
| 6,635,993 | B1 * | 10/2003 | Niimi | 313/623 |
| 6,642,654 | B2 | 11/2003 | Niimi | |
| 6,657,388 | B2 | 12/2003 | Wijenberg et al. | |
| 6,750,612 | B2 | 6/2004 | Takagaki et al. | |
| 6,781,292 | B2 | 8/2004 | Ishida et al. | |
| 6,791,267 | B2 | 9/2004 | Niimi | |
| 6,812,642 | B1 | 11/2004 | Niimi | |
| 6,815,894 | B2 | 11/2004 | Takagaki et al. | |
| 6,873,109 | B2 | 3/2005 | Ishigami et al. | |
| 2002/0027421 | A1 | 3/2002 | Kaneko et al. | |
| 2002/0117965 | A1 | 8/2002 | Kotter et al. | |
| 2003/0080684 | A1 * | 5/2003 | Okuyama | 313/625 |
| 2004/0108814 | A1 | 6/2004 | Tsuda et al. | |
| 2004/0119414 | A1 * | 6/2004 | Bewlay et al. | 313/636 |
| 2004/0124776 | A1 | 7/2004 | Iorio | |
| 2004/0135510 | A1 | 7/2004 | Bewlay et al. | |
| 2004/0174121 | A1 | 9/2004 | Tsuda et al. | |
| 2004/0183446 | A1 | 9/2004 | Grundmann et al. | |
| 2005/0007020 | A1 | 1/2005 | Tsuda et al. | |
| 2005/0162088 | A1 * | 7/2005 | Lee | 313/634 |
| 2006/0001346 | A1 | 1/2006 | Vartuli et al. | |
| 2006/0008677 | A1 | 1/2006 | Bewlay et al. | |
| 2006/0012306 | A1 | 1/2006 | Bewlay et al. | |
| 2006/0068679 | A1 | 3/2006 | Bewlay et al. | |
| 2006/0100088 | A1 | 5/2006 | Loureiro et al. | |
| 2007/0001610 | A1 | 1/2007 | Bewlay et al. | |
| 2007/0001611 | A1 | 1/2007 | Bewlay et al. | |
| 2007/0001612 | A1 | 1/2007 | Bewlay et al. | |

FOREIGN PATENT DOCUMENTS

| | | |
|---|---|---|
| EP | 0935278 | 8/1999 |
| EP | 1150337 | 10/2001 |
| EP | 1158567 | 11/2001 |
| EP | 1172839 | 1/2002 |
| EP | 1172840 | 1/2002 |
| EP | 0650184 B1 | 6/2002 |
| EP | 1220295 | 7/2002 |
| EP | 1253616 | 10/2002 |
| EP | 1296355 | 3/2003 |
| EP | 1351276 | 10/2003 |
| EP | 1363313 | 11/2003 |
| EP | 1434247 | 6/2004 |
| JP | 2004214194 | 7/2004 |
| WO | WO9825294 | 6/1998 |
| WO | WO03058674 | 7/2003 |
| WO | WO03099741 | 12/2003 |
| WO | WO2004023517 | 3/2004 |
| WO | WO2004049390 | 6/2004 |
| WO | WO2004049391 | 6/2004 |
| WO | WO2004051699 | 6/2004 |
| WO | WO2004051700 | 6/2004 |
| WO | WO2004102614 | 11/2004 |

OTHER PUBLICATIONS

Tokumatsu Tachiwaki et al., "*Novel Synthesis of $Y_3Al_5O_{12}$ (YAG) Leading to Transparent Ceramics*", Solid State Communications, vol. 119, pp. 603-606, 2001.

Lei Wen et al., "*Synthesis of Nanocrystalline Yttria Powder and Fabrication of Transparent YAG Ceramics*", Journal of the European Ceramic Society, vol. 24, pp. 2681-2688, 2003.

D. Hreniak et al., "*Synthesis and Optical Properties of $Nd^3$+—Doped $Y_3Al_5O_{12}$ Nanoceramics*", Journal of Alloys and Compounds, vol. 341, pp. 183-186, 2002.

Guanshi Qin et al., "*Upconversion Luminescence of $Er^3$+ In Highly Transparent YAG Ceramics*", Solid State Communications, vol. 132, pp. 103-106, 2004.

Jianren Lu et al., "*Neodymium Doped Yttrium Aluminum Garnet ($Y_3Al_5O_{12}$) Nanocrystalline Ceramics—A New Generation of Solid State Laser and Optical Materials*", Journal of Alloys and Compounds, vol. 341, pp. 220-225, 2002.

A.K. Pradhan et al., "*Synthesis of Neodymium-Doped Yttrium Aluminum Garnet (YAG) Nanocrystalline Powders Leading to Transparent Ceramics*", Materials Research Bulletin, vol. 39, pp. 1291-1298, 2004.

* cited by examiner

100
STEP 1
STEP 2
STEP 3
STEP 4
STEP 5
STEP 6

100
STEP 1
STEP 2
STEP 3
STEP 4
STEP 5
STEP 6

LAMP HAVING AXIALLY AND RADIALLY GRADED STRUCTURE

BACKGROUND

The invention relates generally to lamps and, more particularly, techniques to reduce the potential for thermal stresses and cracking in high intensity discharge (HID) lamps.

High-intensity discharge lamps are often formed from a ceramic tubular body or arc tube that is sealed to one or more end structures. The end structures are often sealed to this ceramic tubular body using a seal glass, which has physical and mechanical properties matching those of the ceramic components and the end structures. Sealing usually involves heating the assembly of the ceramic tubular body, the end structures, and the seal glass to induce melting of the seal glass and reaction with the ceramic bodies to form a strong chemical and physical bond. The ceramic tubular body and the end structures are often made of the same material, such as polycrystalline alumina (PCA). However, certain applications may require the use of different materials for the ceramic tubular body and the end structures. In either case, various stresses may arise from the sealing process, the interface between the joined components, and the materials used for the different components. For example, the component materials may have different mechanical and physical properties, such as different coefficients of thermal expansion (CTE), which can lead to residual stresses and sealing cracks. These potential stresses and sealing cracks are particularly problematic for high-pressure lamps.

The geometry of the interface between the ceramic tubular body and the end structures also may attribute to the foregoing stresses. For example, the end structures are often shaped as a plug or a pocket, which interfaces both the flat and cylindrical surfaces of the ceramic tubular body. If the components have different coefficients of thermal expansion and elastic properties, then residual stresses arise because of the different strains that prevent relaxation of the materials to stress free states. For example in the case of the plug type end structure, if the plug has a lower coefficient of thermal expansion than the ceramic tubular body and seal glass, then tensile stresses arise in the ceramic-seal glass region while compressive stresses arise in the plug region upon cool-down after sealing.

In addition to the ceramic tubular body and end structures, high-intensity discharge lamps also include a variety of internal materials (e.g., gases) and electrode materials to create the desired high-intensity discharge for lighting. The particular internal materials disposed in the high-intensity discharge lamps can affect the sealing characteristics, the light characteristics, and the type of materials that may be workable for the lamp components and the seal glass. For example, certain internal materials, such as halides and metal halides, may be desirable for lighting characteristics, but they are corrosive to some of the ceramic and metallic components that comprise the tubular body and end structure.

BRIEF DESCRIPTION

A lamp is provided with an axially and radially graded structure to reduce the possibility of thermal stresses, cracks, and other defects in the lamp. In one embodiment, a system includes a ceramic lamp having a ceramic arc envelope and an end structure coupled to the ceramic arc envelope, wherein the end structure is graded both axially and radially into a plurality of regions. In another embodiment, a system includes a lamp having a layered end structure with a plurality of layers disposed one over another and that extend in both axial and radial directions relative to an axis of the lamp, wherein the plurality of layers include different materials having different coefficients of thermal expansion, Poisson's ratios, or elastic moduli, or a combination thereof.

DRAWINGS

These and other features, aspects, and advantages of the present invention will become better understood when the following detailed description is read with reference to the accompanying drawings in which like characters represent like parts throughout the drawings, wherein.

Figure 1:
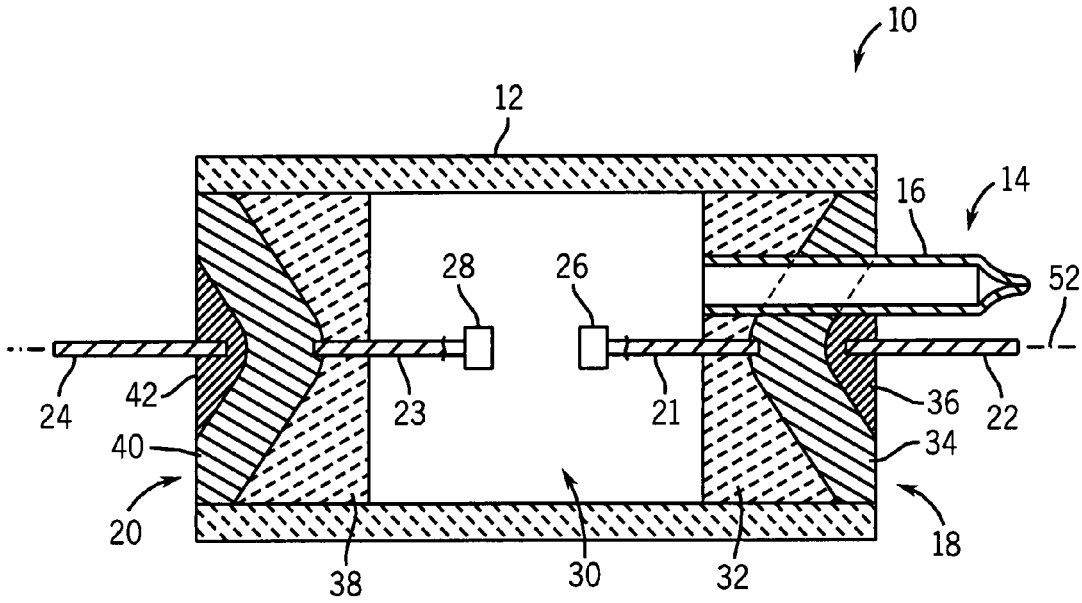
FIG. 1 is a cross-sectional view of a lamp having end structures with both axially and radially graded portions in accordance with certain embodiments of the present invention.
Figure 2:
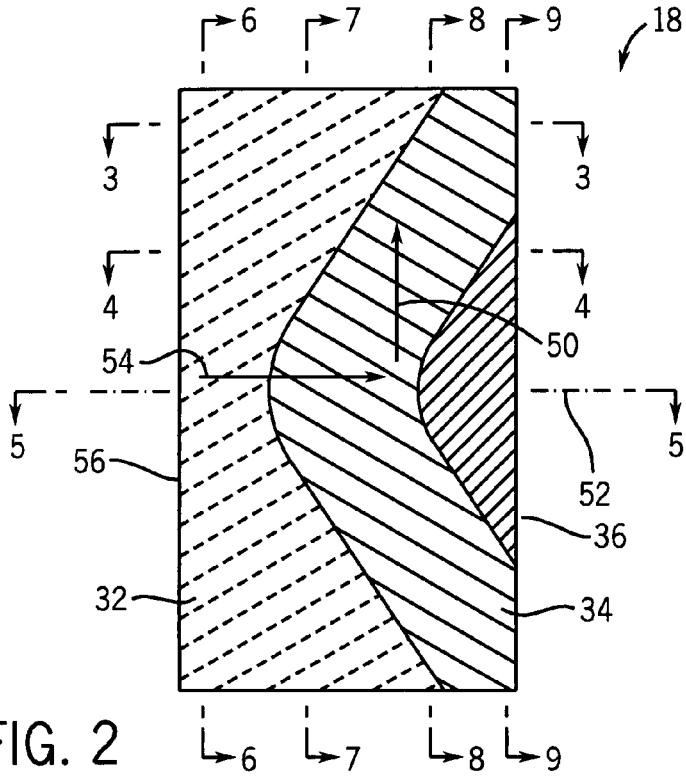
FIG. 2 is a cross-sectional view of one of the end structures illustrating three portions disposed both axially and radially about one another.
Figure 3:
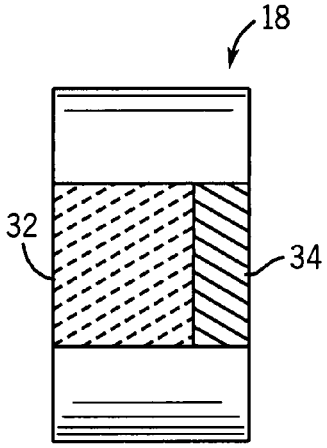
Figure 4:
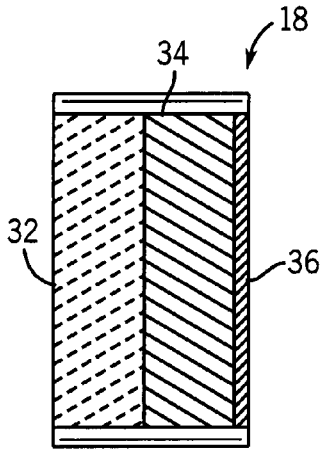
Figure 5:
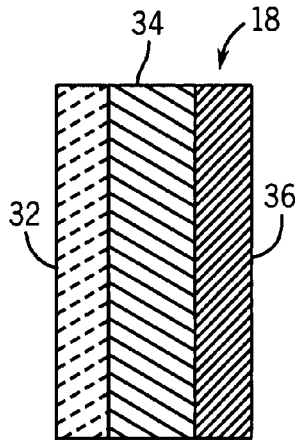
Figure 10:
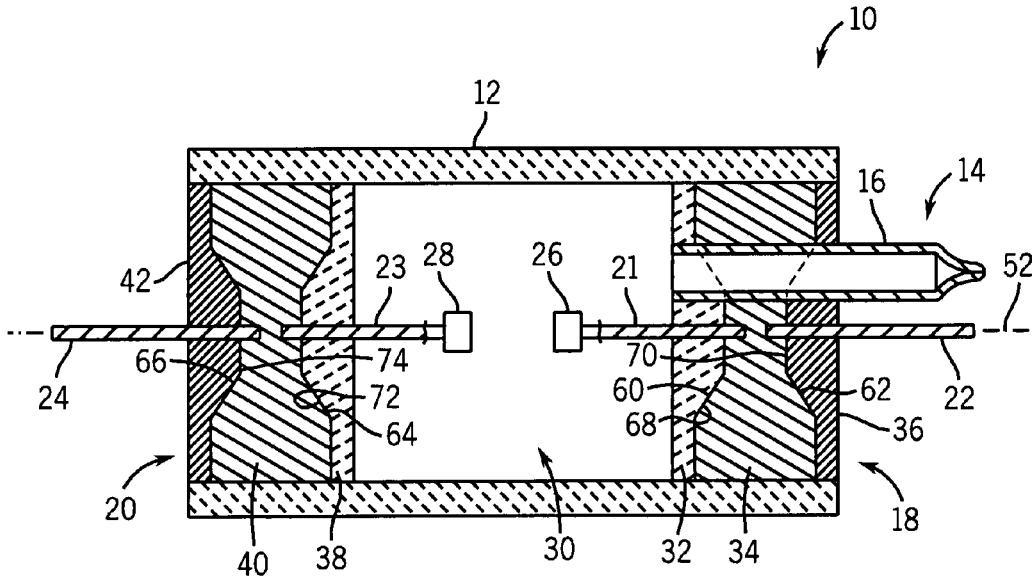
Figure 11:
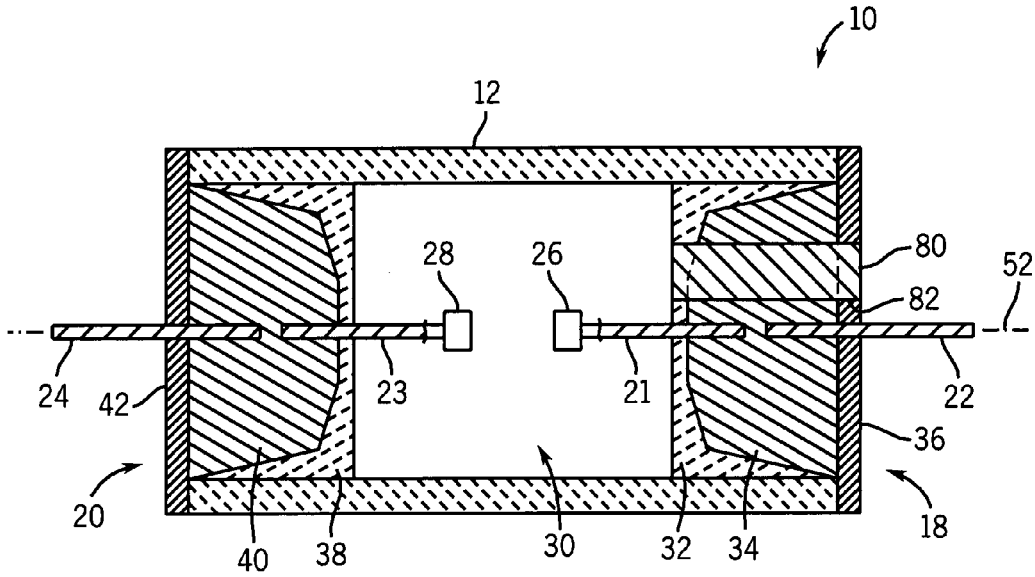

FIGS. 3, 4, and 5 are cross-sectional views of the end structure of FIG. 2, further illustrating the three portions disposed one after another in an axial direction through the end structure;

FIGS. 6, 7, 8, and 9 are cross-sectional views of the end structure of FIG. 2, further illustrating the three portions disposed concentrically about one another in a radial direction through the end structure;

FIGS. 10 and 11 are cross-sectional views of the lamp of FIG. 1, further illustrating alternative embodiments of the axially and radially graded portions of the end structures;

FIGS. 12A, 12B, 12C, 12D, 12E, and 12F are a series of cross-sections illustrating an exemplary process of making a lamp having graded end structures with both axially and radially graded portions; and FIGS. 13A, 13B, 13C, 13D, 13E, and 13F are a series of cross-sections illustrating another exemplary process of making a lamp having graded end structures with both axially and radially graded portions.

DETAILED DESCRIPTION

One or more specific embodiments of the present invention will be described below. In an effort to, provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

FIG. 1 is a cross-sectional view of a lamp 10 in accordance with certain embodiments of the present invention. As discussed in detail below, the lamp 10 includes one or more components with both axially and radially graded regions of different materials having different material characteristics (e.g., coefficient of thermal expansion, Poisson's ratio, or elastic modulus, or a combination thereof). In other words, the different regions have different material compositions that change in both the axial and radial directions. For example, these regions may appear as a plurality of axial layers and radial layers when viewed through cross sections of the particular component, as illustrated in FIGS. 2-9. Thus, these regions create a stepwise change in the material characteristics (e.g., coefficient of thermal expansion, Poisson's ratio, or the elastic modulus, or a combination thereof) between components of the lamp 10, thereby reducing the possibility of thermal stresses and cracking. In some embodiments, the various graded regions may blend together to some extent, or the graded regions may be sufficiently thin and numerous, such that the material characteristics at least substantially continuously change (e.g., increase or decrease) in both the axial and radial directions in the particular components.

As illustrated, the lamp 10 includes a hermetically sealed assembly of a hollow body or arc envelope 12, a dosing structure 14 having a dosing tube 16 extending through an end structure 18, and an end structure 20. As illustrated, the arc envelope 12 has a cylindrical or tube-shaped geometry, while the end structure 20 has an axially and radially graded plug-shaped geometry. The lamp 10 also has lead wires 22 and 24 extending into the end structures 18 and 20 toward an interior of the arc envelope 12. In the arc envelope, arc electrodes 21 and 23 are coupled to the end structures 18 and 20 and terminate at arc tips 26 and 28. The arc gap between these arc tips 26 and 28 is set according to the distance of insertion of the arc electrodes 21 and 23 into the end structures 18 and 20. An internal dosing material 30 also may be disposed inside the hermetically sealed assembly. For example, certain embodiments of the dosing material 30 include a rare gas and mercury. Other embodiments of the dosing material 30 further include a halide, such as bromine, or a rare-earth metal halide.

As discussed in detail below, various embodiments of the end structures 18 and 20 include a plurality of layers of different materials, such as a ceramic, a metal, and various cermets having different ceramic-metal compositions. Specifically, these different materials are arranged to provide both a radial gradient and an axial gradient in the materials and their characteristics (e.g., coefficient of thermal expansion, Poisson's ratio, or elastic modulus, or a combination thereof) throughout the end structures 18 and 20. For example, the illustrated end structure 18 includes axially and radially graded regions 32, 34, and 36, which may include a ceramic, a first cermet (e.g., a first percent by volume metal cermet), and a different second cermet (e.g., a second percent by volume metal cermet), respectively. Similarly, the illustrated end structure 20 includes axially and radially graded regions 38, 40, and 42, which may include a ceramic, a first cermet (e.g., a first percent by volume metal cermet), and a different second cermet (e.g., a second percent by volume metal cermet), respectively. In certain embodiments, the ceramic may be the same or similar to the arc envelope 12, such as polycrystalline alumina, as discussed in further detail below. In addition, the first and second cermets may include a suitable metal, such as tungsten and/or molybdenum, that is also used at least to some extent for the arc electrodes 21 and 23, the lead wires 22 and 24, and/or the dosing tube 16.

In some embodiments, the end structures 18 and 20 may include a cermet-ceramic structure having a number of layers extending about one another in both axial and radial directions, wherein the number is greater than two, and wherein a volume fraction of metal is changed from a low to a high either continuously or in steps either from an outside to an inside of the end structure or, alternatively, from the inside to the outside of the end structure. For example, the low may be 0 percent and the high may be 100 percent. In one specific embodiment, a first layer includes a ceramic, a second layer includes the ceramic and about 5 to 15 volume percent refractory metal, and a third layer includes the ceramic and about 35 to 65 volume percent refractory metal. For example, the metal may include a refractory metal, such as tungsten, molybdenum, rhenium, or tantalum, or a combination thereof. By further example, the ceramic may include polycrystalline alumina (PCA), yttrium-aluminum-garnet, ytterbium-aluminum-garnet, microgram polycrystalline alumina (μPCA), alumina or single crystal sapphire, yttria, spinel, ytterbia, or a combination thereof. Furthermore, the number of layers may be selected to minimize the potential for thermal stress in the end structures 18 and 20, or such that the thermal stress generated within the end structures 18 and 20 is not significant to cause cracking.

As a result, the regions 32, 34, 36, 38, 40, and 42 provide a stepwise change in the material characteristics (e.g., coefficient of thermal expansion, Poisson's ratio, or the elastic modulus, or a combination thereof) in both the radial and axial directions, thereby decreasing the possibility of thermal stresses and cracking within the lamp 10. For example, the coefficient of thermal expansion, Poisson's ratio, or elastic modulus, or a combination thereof, may increase from one portion/layer to another across the plurality of portions at each end structure 18 and 20. In addition, the different materials may have a ceramic percentage that decreases and a metallic percentage that increases from one portion/layer to another across the plurality of portions at each end structure 18 and 20. In one embodiment, the first portion/layer is made of alumina, the second layer is made of alumina and about 5-15% tungsten by volume, and the third layer is made of alumina and about 35-65% by volume of molybdenum. In addition, the geometry of these portions or at the interface between these portions 32, 34, 36, 38, 40, and 42 may include a generally convex geometry, a generally concave geometry, a cup-shaped geometry, a plug-shaped geometry, a stepped geometry, a conical geometry, a disc-shaped geometry, or a combination thereof. Various embodiments and details of these radial and axial gradients are discussed in further detail below with reference to the subsequent figures.

In addition, certain embodiments of the lamp 10 are bonded or sealed together by one or more seal materials, a material diffusion or co-sintering process, localized heating, and/or other suitable techniques. For example, one embodiment of the lamp 10 has a seal material applied between the end structures 18 and 20 and opposite end portions of the arc envelope 12. In another embodiment, the end structures 18 and 20 are bonded to opposite end portions of the arc envelope 12 via material diffusion without using any seal material (e.g., a seal material free bond). Similarly, some embodiments of the lamp 10 have the dosing tube 16 and the lead wires 22 and 24 bonded to the respective end structures 18 and 20 by the application of one or more seal materials, material diffusion, and/or localized heating. After injecting the dosing material 30 into the arc envelope 12, the dosing tube 16 is sealed by localized heating, cold welding, crimping, and/or other suitable sealing techniques.

Various embodiments of the lamp 10 also have a variety of different lamp configurations and types, such as a high intensity discharge (HID) or an ultra high intensity discharge (UHID) lamp. For example, certain embodiments of the lamp 10 comprise a high-pressure sodium (HPS) lamp, a ceramic metal halide (CMH) lamp, a short arc lamp, an ultra high pressure (UHP) lamp, or a projector lamp. Thus, the lamp 10 may be part of a video projector, a vehicle light, a vehicle, or a street light, among other things. As mentioned above, the lamp 10 is uniquely sealed to accommodate relatively extreme operating conditions. Externally, some embodiments of the lamp 10 are capable of operating in a vacuum, nitrogen, air, or various other gases and environments. Internally, some embodiments of the lamp 10 retain pressures exceeding 200, 300, or 400 bars and temperatures exceeding 1000, 1300, or 1400 degrees Kelvin. For example, certain configurations of the lamp 10 operate at internal pressure of 400 bars and an internal temperature at or above the dew point of mercury at 400 bars, i.e., approximately 1400 degrees Kelvin. These higher internal pressures are also particularly advantageous to short arc lamps, which are capable of producing a smaller (e.g., it gets smaller in all directions) arc as the internal lamp pressure increases. Different embodiments of the lamp 10 also hermetically retain a variety of dosing materials 30, such as a rare gas and mercury. In some embodiments, the dosing material 30 comprises a halide (e.g., bromine, iodine, etc.) or a rare earth metal halide.

The components of the lamp 10 are formed from a variety of materials, which are either identical or different from one another. For example, embodiments of the arc envelope 12 are formed from a variety of transparent ceramics and other materials, such as yttrium-aluminum-garnet, ytterbium-aluminum-garnet, micrograin polycrystalline alumina (μPCA), alumina or single crystal sapphire, yttria, spinel, and ytterbia. Other embodiments of the arc envelope 12 are formed from conventional lamp materials, such as polycrystalline alumina (PCA). However, the foregoing materials advantageously provide lower light scattering and other desired characteristics. Various embodiments of the arc envelope 12 also have different forms, such as a bulb, a cylinder, a semi-sphere, or any other suitable hollow body.

In addition, the illustrated arc electrodes 21 and 23 and the lead wires 22 and 24 penetrate the end structures 18 and 20 without extending entirely through the end structures 18 and 20 and without directly contacting one another. Thus, the electricity passes through the body of the end structures 18 and 20 due to the percent by volume of metal in the cermets. In other embodiments, the arc electrodes 21 and 23 may directly connect with the respective lead wires 22 and 24. The arc electrodes 21 and 23 and the lead wires 22 and 24 are made of any suitable materials, such as tungsten or molybdenum. Some embodiments of the lamp 10 have these arc electrodes 21 and 23 and lead wires 22 and 24 diffusion bonded to the end structures 18 and 20. For example, exemplary diffusion bonds include a tungsten diffusion bond or a molybdenum diffusion bond between the respective components.

The dosing tube 16 also can be made of a variety of materials, such as an alloy of molybdenum and rhenium, both of which are stable against hot halides disposed within the lamp 10. An exemplary molybdenum-rhenium alloy has about 35-55% by weight of rhenium. In certain embodiments, the molybdenum-rhenium alloy comprises about 44-48% by weight of rhenium. Alloys of molybdenum and rhenium are also sufficiently ductile to allow the dosing tube 16 to be hermetically sealed via a crimping process, a cold welding process, or any other suitable mechanical deformation technique. However, in an exemplary embodiment of the lamp 10, the initial hermetic seal of the dosing tube 16 is made without external heat (e.g., via cold welding). In this manner, the volatile components of the dosing materials 30 are not unduly heated within the arc envelope 12. Moreover, the cold welding substantially eliminates thermal shock to the arc envelope 12 and the other components of the lamp 10. If desired, localized heating is applied to the cold weld to facilitate a stronger seal of the dosing tube 16. For example, if a crimping tool is used to provide the cold weld, then one technique of applying localized heat is to heat the crimp jaws of the tool. Another localized heating technique involves applying localized heat to the cold weld after its initial creation by the tool. In this manner, the localized heat ensures that the cold welded or crimped dosing tube 16 withstands higher pressures, such as internal pressures exceeding 1 to 500 atmospheres (e.g., 200, 300 or 400 atm.) Laser welding is one exemplary localized heating technique.

During assembly of the lamp 10, the dosing tube 16 enables the volume of the arc envelope 12 to be evacuated and back filled with the desired dosing material 30, such as a rare gas, mercury, halides, and metal halides. An exemplary embodiment of the evacuation and back fill process is performed by attaching the dosing tube 16 to a suitable processing station, as opposed to handling the assembly in a dry box and/or furnace. This is particularly advantageous when the room temperature rare gas pressure in the arc envelope 12 is substantially above one bar.

FIG. 2 is a cross-sectional view of the end structure 18 of FIG. 1, further illustrating the axially and radially graded portions 32, 34, and 36 without the dosing tube 16, the arc electrode 21, and the lead wire 22. In the present embodiment, the end structure 20 also may be represented generally by the cross-section of FIG. 2. However, in some embodiments, the end structures 18 and 20 may have different geometries and material compositions in the portions 32, 34, and 36 relative to the portions 38, 40, and 42.

As illustrated in FIG. 2, the portions 32, 34, and 36 are disposed both concentrically about one another in a radial direction 50 relative to an axis 52 and also one after another in an axial direction 54 along the axis 52 of the end structure 18. FIGS. 3, 4, and 5 illustrate the axial grading or layering of the portions 32, 34, and 36 in the axial direction 54 through the end structure 18 with reference to lines 3-3, 4-4, and 5-5, respectively. For example, FIG. 3 illustrates only the portions 32 and 34 without the portion 36 in the outer perimeter of the end structure 18 as illustrated by line 3-3. Further in toward the axis 52, FIG. 4 illustrates the portions 32, 34, and 36 one after another with a relatively small thickness of the portion 36 as compared to the portions 32 and 34. Finally, along the axis 52, FIG. 5 illustrates all three portions 32, 34, and 36 one after another in the axial direction 54 with relatively equal amounts of each portion 32, 34, and 36. However, as appreciated, the thickness and arrangement of these various portions 32, 34, and 36 may vary in certain embodiments of the end structure 18. Moreover, other embodiments of the end structure 18 may have fewer or greater numbers of the graded portions, such as 2, 4, 5, 6, 7, 8, 9, teens, twenties, thirties, or more graded portions.

Figure 6:
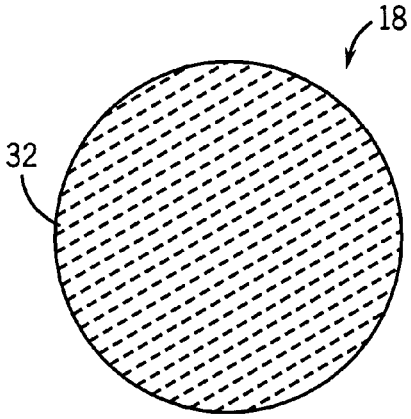
Figure 7:
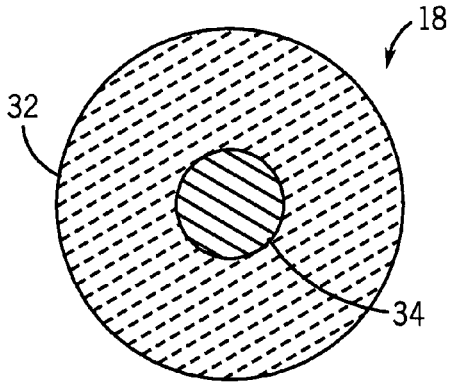

Again, FIGS. 6, 7, 8, and 9 illustrate the portions 32, 34, and 36 disposed concentrically about one another. For example, FIG. 6 is a cross-section of the end structure 18 along line 6-6, wherein only the portion 32 resides without any of the portions 34 and 36. Further along the axis 52 in the direction 54, FIG. 7 illustrates the portion 32 disposed concentrically about the portion 34, wherein the portion 34 is a relatively small amount as compared with the portion 32.

Figure 8:
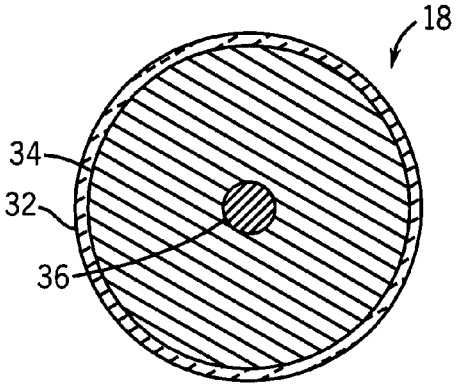
Figure 9:
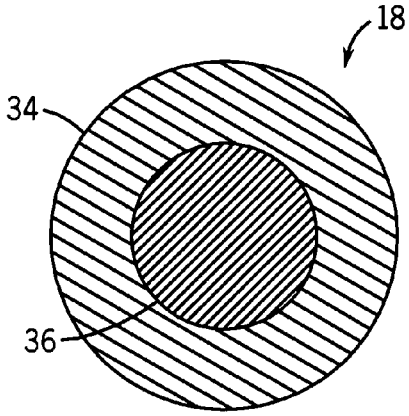

Continuing along the axis 52 in the direction 54, FIG. 8 illustrates the portions 32, 34, and 36 disposed concentrically about one another, wherein the outer portion 32 and the inner portion 36 are relatively small amounts as compared to the intermediate portion 34. Finally, along line 9-9 of FIG. 2, the end structure 18 as illustrated in FIG. 9 has only the outer portion 34 disposed about the inner portion 36, wherein the inner portion 36 is about half of the diameter of the outer portion 34. In all of these FIGS. 6, 7, 8, and 9, the portions 32, 34, and 36 appear as circular or annular layers that stack about one another toward the axis 52. Moreover, the portions 32, 34, and 36 simultaneously form the axial layers as illustrated in FIGS. 3, 4, and 5 and the radially or concentric layers as illustrated in FIGS. 6, 7, 8, and 9.

Overall, the end structure 18 of FIG. 2 may be electrically conductive and also enabled improved sintering/bonding with ceramic components, such as the arc envelope 12. The geometry and material compositions of portions 32, 34, and 36 are designed to minimize the thermal stresses due to the temperature gradient in the end of the lamp 10, and the different thermal expansion coefficients and elastic moduli of the individual portions 32, 34, and 36 of the end structure 18. In the illustrated embodiment, the first portion 32 is entirely a ceramic, such as alumina or another similar arc envelope material, with the exception of regions that are penetrated by the arc electrode 21 and dosing tube 16. The ceramic face 56 of the end structure 18 provides a lamp closure element that is resistant to halide corrosion and back arcing during lamp operation. The all ceramic composition of the portion 32 also eliminates the need for seal glass, which in turn eliminates undesirable interactions between the seal glass and dosing material 30 disposed within the lamp 10. Moreover, the ceramic composition of the portion 32 also can sinter or diffusion bond very effectively with the ceramic composition of the arc envelope 12, thereby forming a bond that can withstand very high pressure.

Regarding the other portions 34 and 36, the second portion 34 of the end structure 18 may include a conductive cermet (e.g., alumina 8% by volume of tungsten) that is fabricated to provide similar thermal expansion behavior to alumina and to be electrically conductive. The third portion 36 of the end structure 18 may include a conductive cermet with a higher volume fraction of a refractory metal, for example, alumina 50% by volume of molybdenum or alumina 50% by volume of tungsten. Thus, the composition of the third portion 36 provides a less than optimal thermal expansion match with alumina, but the higher volume fraction of metal provides for improved weldability to metallic components, such as the lead wire 22 for connection to external devices. In other embodiments, the portions 32, 34, and 36 may have other compositions of ceramics, metals, cermets, and combinations thereof, such that the thermal expansion characteristics increase or decrease in a stepwise manner for bonding with different components of the lamp 10.

FIG. 10 is cross-sectional view of an alternative embodiment of the lamp 10 of FIG. 1, further illustrating a different configuration of the graded portions 32, 34, and 36 in the end structure 18 and the graded portions 38, 40, and 42 in the end structure 20. As illustrated, the intermediate portions 34 and 40 have a generally I-shaped cross-section, while the surrounding portions 32, 36, 38, and 42 have opposite cross-sections that fit like a puzzle with the I-shaped cross-section of the portions 34 and 40. In other words, the portion 34 of the end structure 18 has a disc-shaped geometry with inwardly stepped sides 60 and 62 disposed in the central region about the axis 52. Similarly, the portion 40 of the end structure 20 has inwardly stepped sides 64 and 66. In an opposing configuration, the portions 32 and 36 of the end structure 18 have disc-shaped geometries with outwardly stepped sides 68 and 70 in the central region about the axis 52. Similarly, the opposing portions 38 and 42 of the end structure 20 have outwardly stepped sides 72 and 74 in the central region about the axis 52.

In the illustrated embodiment, the first portion 32 is entirely ceramic, such as alumina, to provide a close thermal expansion match and effective diffusion bonding with the ceramic of the arc envelope 12. The second portion 34 is a low percent by volume of metal cermet (e.g. less than 20% by volume of metal), while the third portion 36 is a relatively higher percent by volume of metal cermet (e.g., 20-70% by volume of metal). The portions 38, 40, and 42 of the end structure 20 also have similar compositions to those of the portions 32, 34, and 36. In the illustrated embodiment, the arc electrodes 21 and 23 extend entirely through the first portions 32 and 38 and partially into the second portions 34 and 40 without connecting with the corresponding lead wires 22 and 24, respectively. Similarly, the lead wires 22 and 24 extend through the third portions 36 and 42 and partially into the second portions 34 and 40 without connecting with the arc electrodes 21 and 23, respectively. Again, the second and third portions 34, 36, 40, and 42 are electrically conductive cermets, which enable electricity to pass through the end structures 18 and 20 to the arc electrodes 21 and 23 to form an arc between the tips 26 and 28.

FIG. 11 is a cross-sectional view of an alternative embodiment of the lamp 10 of FIG. 1, further illustrating an alternative arrangement of portions 32, 34, 36, 38, 40, and 42 within the end structures 18 and 20. In the illustrated embodiment, the end structure 18 includes a plug 80 disposed in a dosing passage 82. Specifically, the plug 80 may be sealed within the dosing passage 82 after filling the lamp 10 with the dosing material 30. For example, the plug 80 may be co-sintered with the lamp 10 to provide a diffusion bond between the plug 80 and the portions 32, 34, and 36. Alternatively, the plug 80 may be laser welded or otherwise sealed within the dosing passage 82 after filling the lamp 10 with the dosing material 30. In addition, the illustrated lamp 10 has a different geometry of the portions 32, 34, and 36 of the end structure 18 and the portions, 38, 40, and 42 of the end structure 20. Specifically, the portions 32 and 38 have an outer cup-shaped geometry, the portions 34 and 40 have a central plug-shaped geometry, and the portions 36 and 42 have a generally flat disc-shaped geometry. Again, these portions 32, 34, 36, 38, 40, and 42 may have similar material compositions as discussed in detail above.

Figures 12A, 12B, 12C, 12D, 12E, 12F:
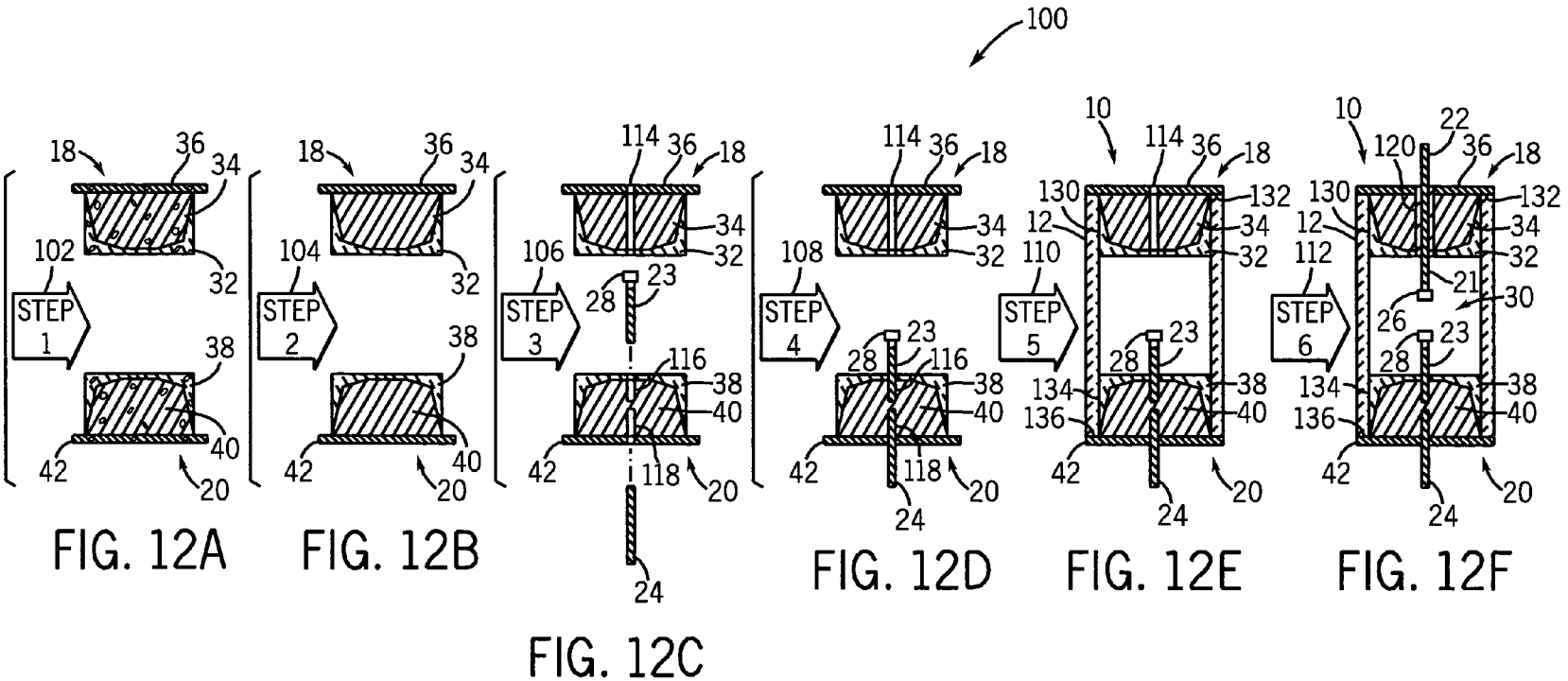
Figures 13A, 13B, 13C, 13D, 13E, 13F:
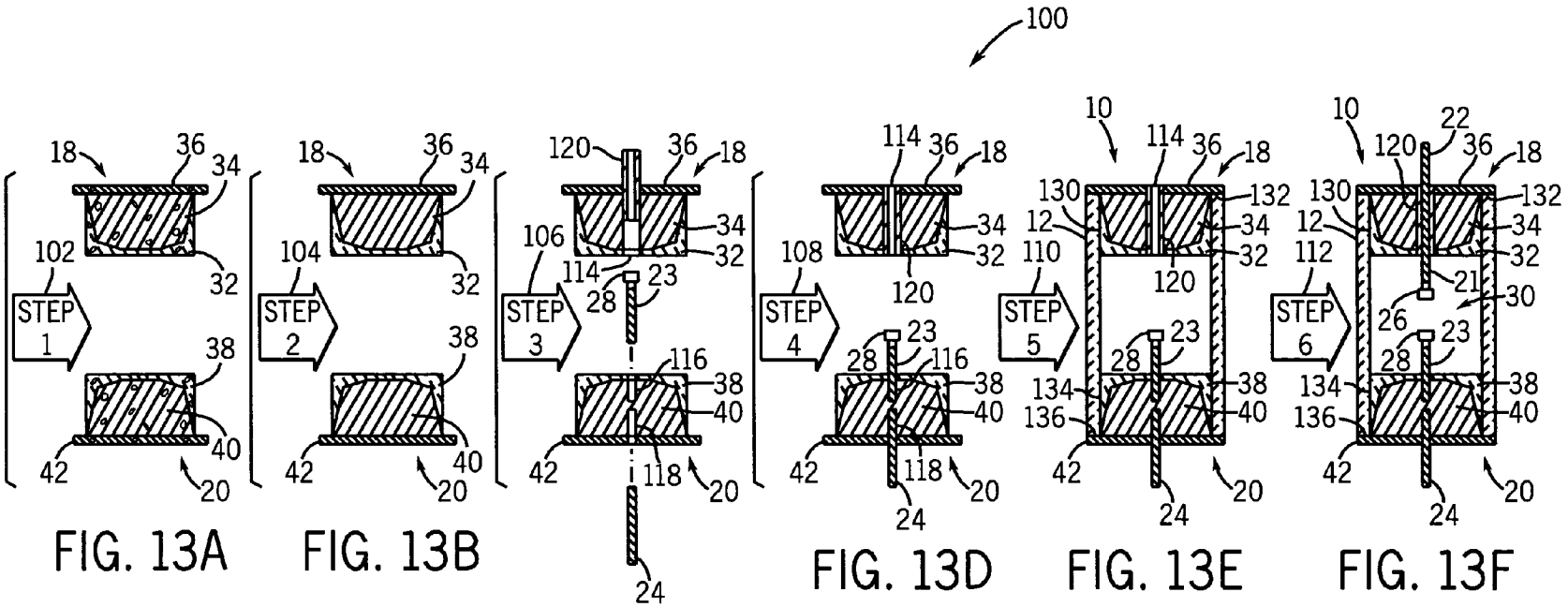

FIGS. 12A, 12B, 12C, 12D, 12E, and 12F are a series of cross-sections illustrating an exemplary process 100 of making an alternative embodiment of the lamp 10 as illustrated in FIG. 11, including steps 1, 2, 3, 4, 5, and 6 as indicated by arrows 102, 104, 106, 108, 110, and 112. Specifically, in the illustrated embodiment, step 1 may include mixing and generally preparing the different materials (e.g., powder form) for the portions 32, 34, 36, 38, 40, and 42 of the end structures 18 and 20, and then pressing, casting, molding, or generally forming these different materials into the specific geometry of the end structures 18 and 20 and the individual portions in each end structure 18 and 20. A powder pressed into the shape of the end structures 18 and 20 will generally have some degree of porosity, as shown in FIG. 12A. In the illustrated embodiment, the end structures 18 and 20 have cup-shaped portions 32 and 38, plug-shaped portions 34 and 40, and disc-shaped portions 36 and 42. After pressing the end structures 18 and 20 in step 1, the materials are generally porous and capable of further densification and shrinkage with the addition of further pressure and/or heat. In the illustrated embodiment, the first portions 32 and 38 have a ceramic composition, such as polycrystalline alumina. The second portions 34 and 40 have a low percent by volume of metal cermet, such as 9% by volume of metal cermet. Finally, the third portions 36 and 42 have a relatively higher percent by volume of metal, such as 50% by volume of metal cermet. For example, these cermet compositions of the second and third portions 34, 36, 40, and 42 may correspond to an alumina tungsten cermet, an alumina molybdenum cermet, or another suitable cermet composition.

In step 2 of FIG. 12B, the process 100 proceeds to pre-sinter the end structures 18 and 20 by applying a suitable amount of heat for a time period that at least partially decreases the porosity and increases the cohesion between the pressed particles of the different materials in the end structures 18 and 20. In step 3 of FIG. 12C, the process 100 proceeds by drilling or generally forming a dosing passage 114 in the end structure 18, and also drilling or generally forming inner and outer receptacles 116 and 118 in the end structure 20. The inner and outer receptacles 116 and 118 are configured to receive the arc electrode 23 and the lead wire 24, respectively. In step 4 of FIG. 12D, the arc electrode 23 is inserted into the inner receptacle 116, while the lead wire 24 is inserted into the outer receptacle 118 in the end structure 20.

In step 5 of FIG. 12E, the process 100 proceeds by inserting the end structures 18 and 20 into the opposite open ends of the arc envelope 12. Step 5 also involves co-sintering the assembled end structures 18 and 20 along with the arc envelope 12 to diffusion bond these various components together. For example, the co-sintering of step 5 creates a ceramic diffusion bond between the portions 32 and 38 of the end structures 18 and 20 with the arc envelope 12. In addition, the co-sintering of step 5 shrinks the material of the end structures 18 and 20 to fit compressively about the arc electrode 23 and the lead wire 24. Moreover, the portions 32, 34, and 36 of the end structure 18 and the portions 38, 40, and 42 of the end structure 20 further densify and diffusion bond with one another to provide the axial and radial gradients at the opposite ends of the arc envelope 12.

In steps 6 of FIG. 12F, the process 100 may proceed to fill the lamp 10 with the dosing materials 30 through the dosing passage 114, and then seal the dosing passage 114 with the arc electrode 21. Specifically, in the illustrated embodiment, the arc electrode 21 is surrounded by a cylinder 120, such as a molybdenum or molybdenum-rhenium cylinder, to improve the interface between the portions 32, 34, and 36 of the end structure 18. For example, as compared to the arc electrode 21, the molybdenum or molybdenum-rhenium cylinder may have a generally closer match with the coefficients of thermal expansion of the ceramic and cermets of the portions 32, 34, and 36. Moreover, step 6 may include sealing or bonding the arc electrode 21 with the surrounding cylinder 120 via a focused heating technique, such as laser welding. In addition, the lead wire 22 may be an integral part of the arc electrode 21 and/or the cylinder 120. Alternatively, the lead wire 22 may be coupled (e.g., welded) to the arc electrode 21 and/or the cylinder 120.

FIGS. 13A, 13B, 13C, 13D, 13E, and 13F are a series of cross-sections illustrating an alternative embodiment of the process 100 of FIG. 12, wherein the cylinder 120 is inserted into the dosing passage 114 in step 3. Subsequently, in step 5, the cylinder 120 is co-sintered along with the end structures 18 and 20 and the arc envelope 12. Thus, the cylinder 120 generally diffusion bonds with the portions 32, 34, and 36 of the end structure 18. Subsequently, in steps 6, the arc electrode 21 and the lead wire 22 are bonded with the cylinder 120 via a suitable focused heating technique, such as laser welding.

In alternative embodiments, in step 5 of the process 100 shown in FIGS. 12A-F and 13A-F, the end structures 18 and 20 may be sealed with the arc envelope 12 with a suitable sealing material, such as a seal glass. For example, the seal glass may be disposed at seal interfaces 130 and 132 between the arc envelope 12 and the end structure 18. Similarly, the seal glass may be disposed at seal interfaces 134 and 136 between the end structure 20 and the arc envelope 12.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a ceramic lamp, comprising:

a ceramic arc envelope;

an end structure graded both axially and radially into a plurality of regions comprising a first ceramic region, a second cermet region, and a third cermet region extending about one another in both axial and radial directions relative to an axis and are generally diffused with one another at interfaces between the plurality of regions;

the first ceramic layer diffusion bonded to the ceramic arc envelope;

a lead wire extending entirely through the third cermet region and diffusion bonded to the second cermet region; and an arc electrode extending entirely through the first ceramic region and diffusion bonded to the second cermet region, wherein the lead wire and the arc electrodes penetrate the end structure without extending entirely through the end structure; and at least two of the plurality of regions have non-uniform thicknesses.

2. The system of claim 1, wherein the plurality of regions comprise different materials having different coefficients of thermal expansion, Poisson's ratios, or elastic moduli, or a combination thereof.

3. The system of claim 1, wherein the end structure comprises a cermet-ceramic, wherein a volume fraction of metal is changed from a low to a high either continuously or in steps from the inside to the outside of the end structure.

4. The system of claim 3, wherein the number of regions is selected such that the thermal stress generated within the end structure is not significant to cause cracking.

5. The system of claim 1, wherein the end structure comprises a passage compressively fit about a dosing tube.

6. The system of claim 1, wherein the ceramic arc envelope comprises a ceramic arc tube having first and second ends, the end structure comprises a first end plug disposed into the first end, a second end plug is disposed into the second end, the arc electrode is coupled to the first end plug and disposed as a first arc electrode, a further, second arc electrode is coupled to the second end plug, and both the first and second end plugs comprise a plurality of different materials disposed axially and radially about one another.

7. The system of claim 1, comprising a video projector, a vehicle light, a vehicle, or a street light having the ceramic lamp.

* * * * *